United States Patent [19]

Palau et al.

[11] Patent Number: 4,858,655

[45] Date of Patent: Aug. 22, 1989

[54] ROTATING DOBBY FOR WEAVING LOOMS

[75] Inventors: Joseph Palau, Saint Jorioz; Jean-Paul Froment, Faverges, both of France

[73] Assignee: S.A. Des Etablissements Staubli (France), Faverges, France

[21] Appl. No.: 21,222

[22] Filed: Mar. 3, 1987

[30] Foreign Application Priority Data

Mar. 26, 1986 [FR] France ..... 86 04635

[51] Int. Cl.[4] ..... D03C 1/00

[52] U.S. Cl. ..... 139/76

[58] Field of Search ..... 139/66 R, 76

[56] References Cited

U.S. PATENT DOCUMENTS

| | | | |
|---|---|---|---|
| 4,497,346 | 2/1985 | Hintsch et al. | 139/76 |
| 4,542,769 | 9/1985 | Julich | 139/76 |
| 4,646,788 | 3/1987 | Brock et al. | 139/76 |

*Primary Examiner*—Henry S. Jaudon

*Attorney, Agent, or Firm*—Dowell & Dowell

[57] ABSTRACT

A rotating dobby for weaving looms wherein the oscillating rods which are connected to the heddles are positively and instantaneously retained in a fixed position upon the disengagement of the coupling hooks by way of which the rods are normally engaged with a rotating drive disk.

2 Claims, 3 Drawing Sheets

ROTATING DOBBY FOR WEAVING LOOMS

BACKGROUND OF THE INVENTION

1. Field of the Invention

The present invention relates to the mechanisms for forming the shed in weaving looms, and more particularly to the dobbies of the rotating type, i.e. in which the control of the reciprocating vertical displacement of each heddle frame is ensured by means of an oscillating rod of which one end is coupled to the frame while the opposite end, cut out with an opening, is engaged on an actuating eccentric.

2. History of the Related Art

Applicants' French Patent No. 80 06545 (2 478 682) filed on Mar. 20, 1980 discloses rotating dobbies in which the eccentric, mounted idly on a shaft which is rotated with a stop every 180°, is laterally secured with a projecting plate which provides support for a coupling member intended to link the shaft to the eccentric angularly, at the opportune moment, in order to effect displacement of the rod and of the frame coupled thereto. This coupling member, thus placed outside the eccentric, is an articulated hook which is subjected, against elastic return means, to the action of one or the other of two pivoting selector levers actuated by the reading device of the dobby, as a function of the program incorporated in the reading device. Each of the two opposite ends of the hook comprises a nose element adapted to cooperate with one or the other of two notches made in a drive disc angularly secured to the shaft which rotates intermittently.

It will be understood that, when one of the nose elements of the hook is engaged by the elastic return means inside one of the notches of the drive disc, the eccentric is angularly linked to the shaft and effects actuation of the rod. On the contrary, when one of the pivoting selector levers comes into abutment against the hook, there is no more coupling and the eccentric is therefore not displaced by the shaft, with the result that the rod is not controlled; as, in this position, the other nose element of the hook is engaged in a notch made in an annular boss on the rod. The rod is angularly connected to the eccentric through the hook and is consequently immobilized, thus avoiding any parasitic displacement of the rod under the effect of the weight of the corresponding heddle frame.

SUMMARY OF THE INVENTION

It is an object of the present invention to simplify the construction of the rotating dobbies according to the above-mentioned French Patent, without being detrimental to the operational reliability thereof.

In accordance with the invention, each of the articulated hooks is profiled on its outer edge in order to cooperate, when it is actuated for disconnection, with one or the other of two retaining catch members mounted at two diametrically opposite points with respect to the shaft of the dobby.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
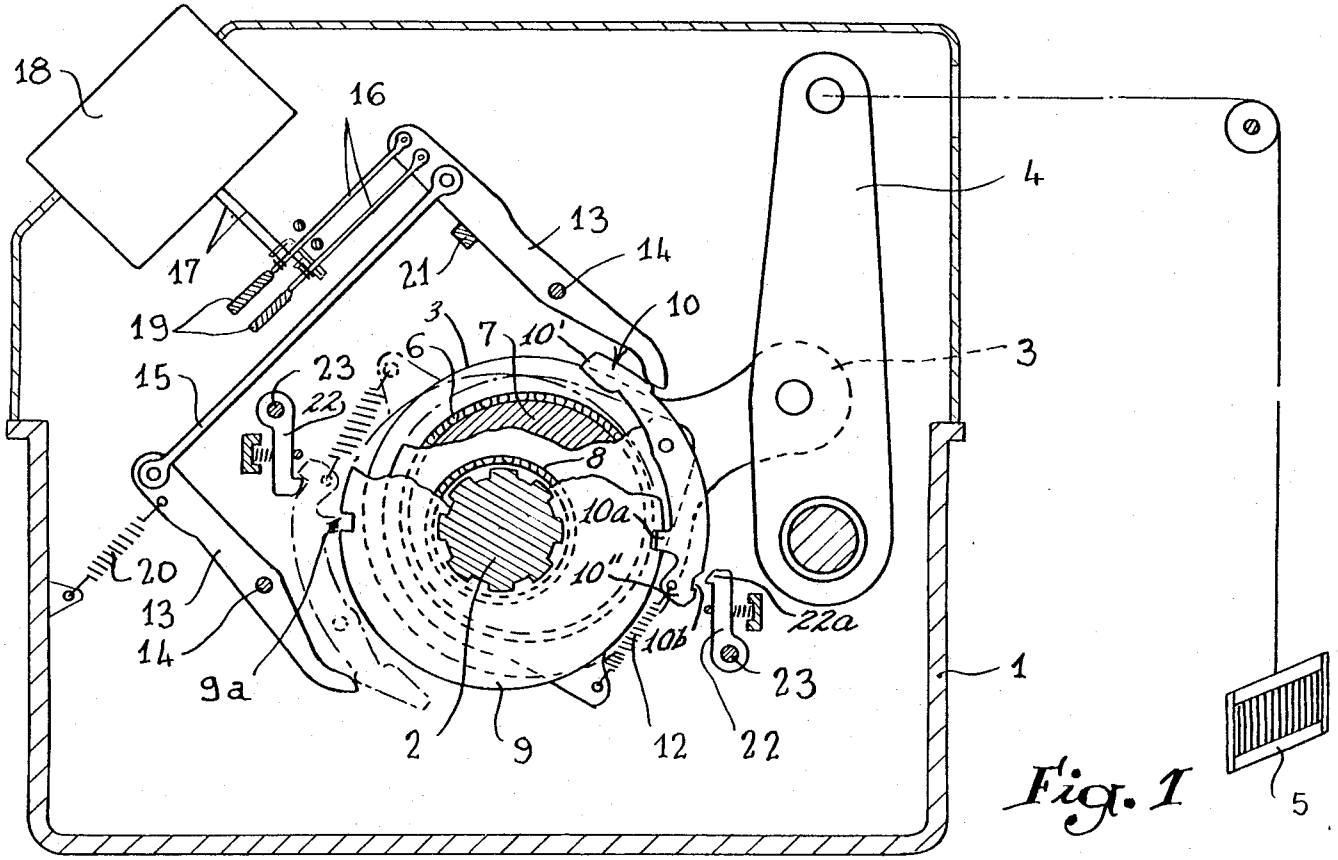
FIG. 1 is a transverse section of a rotating dobby according to the invention, showing the arrangement of one of the assemblies thereof for controlling the heddle frames.

Referring now to the drawings, reference 1 in FIG. 1 designates the frame of the dobby, which supports the principal shaft 2 which is intermittently rotated and stopped every 180°, which shaft is intended to ensure control of a series of oscillating rods 3 of which each is coupled by a lever 4 to one of the heddle frames 5 of the weaving loom associated with the dobby.

Figure 2:
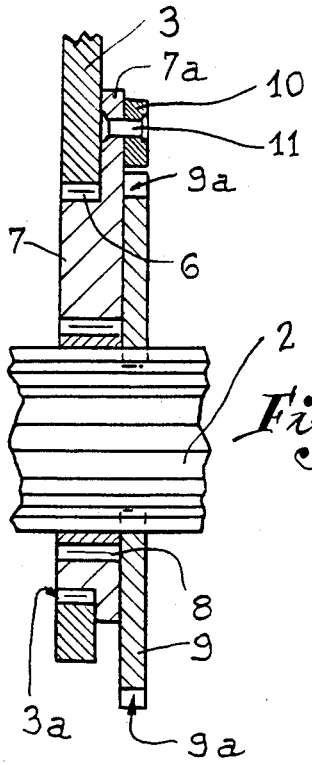
FIG. 2 is a partial axial section of one of these assemblies.

As shown more particularly in FIG. 2, each of the rods 3 is cut out, opposite its point of coupling with its lever 4, with an opening 3*a* which is engaged, with the interposition of roller bearings 6 which are provided on the cylindrical periphery of an actuating eccentric 7. The eccentric is mounted idly on the shaft 2 via a roller bearing 8. With each rod 3 there is associated a drive disc 9 mounted to the shaft 2 and it will be observed that the periphery of this disc 9 has two notches 9*a*, diametrically opposite each other, cut out therein. These two notches 9*a* are adapted to cooperate with an articulated coupling hook 10 mounted on a small pin 11 carried by a plate 7*a* which is formed by a lateral projection of eccentric 7.

Figure 3:
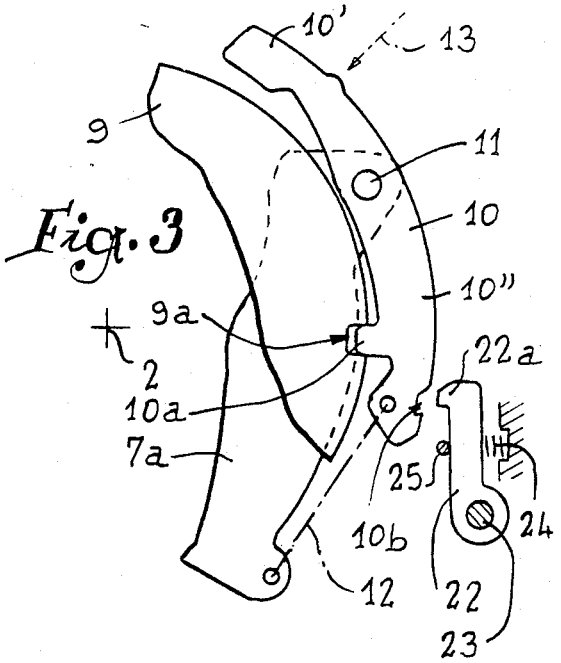
FIGS. 3 and 4 are detailed views illustrating the operation of the pivoting coupling hook.
Figure 4:
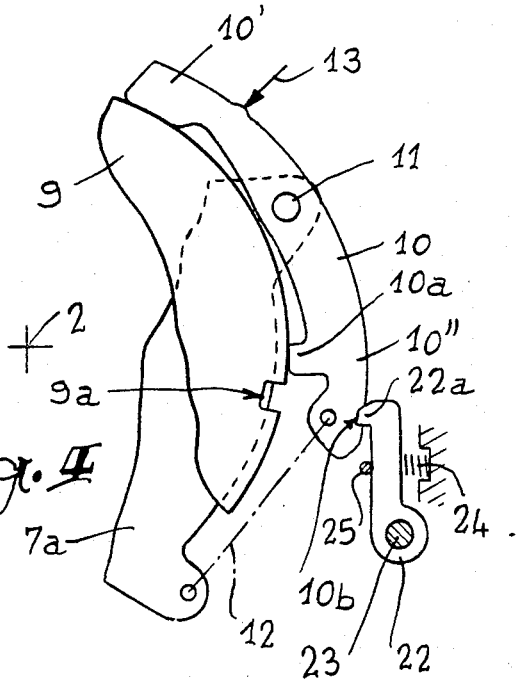

FIGS. 3 and 4 clearly show the profile of the hook 10 which including, on either side of its pivot pin 11, a selection arm 10' and a coupling arm 10''. The edge of this arm 10'' which faces the disc 9 includes a projecting nose element 10*a* adapted, under the effect of elastic return means constituted by a spring 12 connected between the plate 7*a* and the end of the arm 10'' of the hook to permanently bear against the free edge of the disc 9 so as to engage, every time the shaft 2 stops, inside one or the other of the two notches 9*a*.

The hook 10 is controlled, against the spring 12, by the end of two selector levers 13 (FIG. 1) pivotally carried by two fixed pins 14 oriented in parallel to shaft 2. These pivoting levers 13 are coupled to each other by a connecting rod 15 and one of them (the righthand one in FIG. 1) comprises an extension on which are articulated two rods 16 which are displaced transversely to their axis by two needles 17 controlled axially by a programmed reading device 18 operated electronically or mechanically. The transverse displacement of the rods 16 under the effect of the needles 17 enables the rods, in conventional manner, as a function of the program incorporated in the device 18, either to cooperate with two push elements 19 with reciprocating movement, consequently ensuring actuation of the two pivoting levers 13, or to escape the action of the push elements 19, in that case remaining immobile.

It will be observed that a spring 20, interposed between one of the levers 13 and the frame 1, tends to urge the end of the lever 13 with which it is associated in the direction of the shaft 2, and on the contrary to maintain the end of the opposite lever 13 spaced from said shaft, so that the action of this spring 20 is exerted on the rod 15 in a direction opposite to the force exerted by push elements 19. A fixed stop 21 limits the pivoting of the levers 13 under the effect of the spring 20.

Operation of the dobby described hereinabove will be readily understood.

If, when the shaft 2 stops which hook 10 is disposed at the level of upper selector lever 13, the lever receives no action from the reading device 18 (case of FIG. 3), the spring 12 associated with the hook 10 pivots the nose element 10*a* into the notch 9*a* of the drive disc which is then located opposite thereto; consequently, there is a coupling of the shaft 2 and of the eccentric 7 through the hook 10 and the disc 9, with the result that the rod 3 is controlled.

If, on the contrary, when the shaft 2 stops, the upper one of the two selector levers 13 exerts an action on the arm 10' of the hook 10 (see arrow 13 of FIG. 4) in such a manner that the free end of the arm 10' is pushed and that the hook 10 pivots until the free end comes into contact with the periphery of the disc 9, in the manner illustrated in FIG. 4, the nose element 10*a* is disengaged from notch 9*a* and there is no coupling of the eccentric to the shaft; in that case, the eccentric 7 cannot actuate the rod 3.

However, it is indispensable to ensure at that moment the positive immobilization of the rod-eccentric assembly and it is to that end that there is provided in the outer edge of the arm 10" of the hook 10 and beyond the finger 10*a*, a notch 10*b* which is adapted to cooperate with the terminal nose element 22*a* of one or the other of two catch members 22. As shown in FIG. 1, these two catch members 22, oriented opposite each other, are mounted on longitudinal pivots 23 fixed to the frame 1 so as to be located diametrically opposite each other with respect to the shaft 2.

It will be understood that, when the upper one of the selector levers 13 actuates the hook 10 in the manner illustrated in FIG. 4, the arm 10" thereof is projected outwardly, with the result that the notch 10*b* naturally hooks against the nose element 22*a* of the catch member in question; the latter consequently ensures, through hook 10, the angular immobilization of the eccentric 7 and of the rod 3 in the direction of rotation of shaft 2 and eccentric 7. As soon as the action of the upper selector lever 13 on the hook 10 stops, and where the nose element 10*a* has been maintained in alignment with notch 9*a*, the spring 12 associated therewith effects disengagement of the notch 10*b* from the nose element 22*a* of the catch member 22.

Lower selector lever 13 does not strictly operate in the same manner as the upper lever 13. As shown in dotted line in FIG. 1, the end of the lower lever 13 is positioned in such a manner that it automatically actuates the hook 10 so that the notch 10*b* hooks against the nose element 22*a* of the corresponding catch member 22. When the lower lever 13 exerts an action on the hook 10, the hook is released from the catch member 22 under the action of spring 12.

In normal operation, the catch members 22 remain perfectly immobile since it is the articulated hook 10 which hooks the catch member by its notch 10*b*. However, with a view to constituting safety means adapted to operate automatically, each of these catch members 22 is mounted to pivot on its pivot 23 and receives the action of a spring 24 which tends to maintain it applied against a fixed stop 25. Under these conditions, if further to defective operation, the nose element 10*a* of the hook 10 remained partially engaged in one of the notches 9*a* of the disc 9 while the corresponding catch member 22 still retained the hook, furtherto the truncated profile given to this end to the nose element 22*a* and to the notch 10*b*, the effort exerted by the hook on the catch member would provoke pivoting thereof against its spring 24 and thereby release the hook.

It will be observed that the angular immobilization of the rod 3 as ensured according to the invention is considerably simple while proving to be perfectly efficient. The plate 7*a* of the eccentric 7 and the hook 10 itself may be flat comprising no bend nor fold. It will be noted that the functions of coupling and of immobilization are grouped in the same arm 10" of the one hook 10, this making it possible to obtain a very high precision. In addition, and this point should be emphasized, there is force applied on the hook 10 only upon angular immobilization of the rod 3, this considerably limiting wear.

Figure 5:
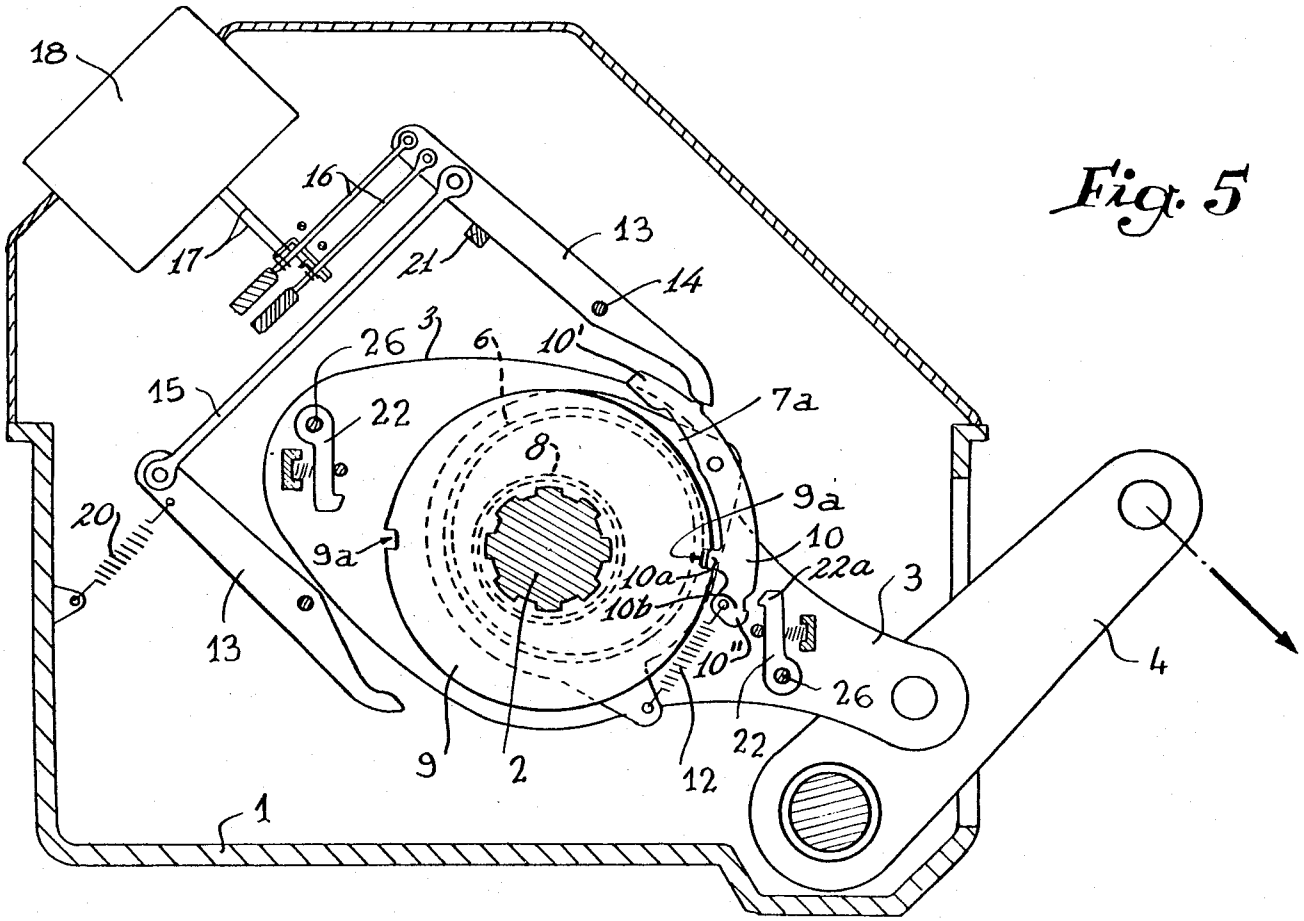
FIG. 5 is a transverse section similar to that of FIG. 1, but corresponding to a variant embodiment of the invention.

It should be noted that an identical result would be obtained by mounting the catch members 22, no longer on common pivots 23 mounted on the fixed frame 1 of the dobby, but on individual pivots 26 provided on each of the rods 3 themselves, in the manner illustrated in FIG. 5. Angular immobilization of each rod 3 is then ensured by connecting the latter to its actuation eccentric 7, as in the prior French Patent mentioned in the preamble.

It must, moreover, be understood that the foregoing description has been given only by way of example and that it in no way limits the domain of the invention which would not be exceeded by replacing the details of execution described by any other equivalents.

What is claimed is:

1. In a dobby of the rotating type for weaving looms which includes an oscillating rod for controlling the movement of the heddle frames, the oscillating rod being mounted on an eccentric which is freely rotatably mounted on a drive shaft, an engagement hook pivotally mounted on an extension of the eccentric and including a coupling arm having a nose portion extending therefrom, a drive disk mounted for rotation with the drive shaft, the drive shaft having opposed notches therein, a pair of pivotally mounted selection arms mounted in opposing relationship on either side of the drive disk, resilient means for normally urging the nose portion of the engagement hook toward the drive disk so that the nose portion is engageable with one of the notches in the drive disk so as to couple the oscillating rod to the drive disk through the engagement hook and eccentric, controls for selectively pivoting the selection arms relative to the drive disk to thereby urge the nose portion of the engagement hook from engagement with a notch of the drive disk in order to operatively disconnect the eccentric and oscillating rod from driven engagement with the drive disk, the improvement comprising:

said coupling arm of said engagement hook having a hook means disposed oppositely of said nose portion, a catch member mounted in facing relationship to said hook means, said catch member being engageable with said hook means when said nose portion thereof is urged from within a notch of the drive disk to thereby immobilize the engagement hook and prevent further motion of the eccentric and the oscillating rod.

2. The dobby for a weaving loom of claim 1 including resilient means mounted adjacent said catch member, said resilient means normally urging said catch member toward said hook means of the engagement hook, said catch member including a hooked nose element which is engageable within said hook means, said nose element being shaped so as to automatically release said hook means when said articulated hook is rotated due to a continued engagement between the nose portion thereof and one of the notches of the drive disk.

* * * * *